US007544080B2

(12) United States Patent
Giefers

(10) Patent No.: US 7,544,080 B2
(45) Date of Patent: Jun. 9, 2009

(54) ELECTRICAL PLUG CONNECTOR COUPLING

(75) Inventor: Stefan Giefers, Detmold (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 12/014,192

(22) Filed: Jan. 15, 2008

(65) Prior Publication Data

US 2008/0119090 A1 May 22, 2008

(51) Int. Cl.
*H01R 13/627* (2006.01)

(52) U.S. Cl. ..... 439/352

(58) Field of Classification Search ..... 439/352, 439/79, 83

See application file for complete search history.

(56) References Cited

U.S. PATENT DOCUMENTS 4,993,967 A * 2/1991 Matsumoto ..... 439/489
5,233,674 A * 8/1993 Vladic ..... 385/56
5,820,398 A * 10/1998 Stabroth et al. ..... 439/352
5,947,763 A * 9/1999 Alaksin ..... 439/489
6,077,101 A * 6/2000 Garretson et al. ..... 439/352
6,250,943 B1 * 6/2001 Castle et al. ..... 439/352
6,261,115 B1 * 7/2001 Pederson et al. ..... 439/352
6,514,099 B2 * 2/2003 Endo ..... 439/489
6,811,424 B2 * 11/2004 Seminara et al. ..... 439/352
6,863,546 B2 * 3/2005 Yang et al. ..... 439/79
6,945,801 B2 * 9/2005 Brown ..... 439/188
7,008,254 B2 * 3/2006 Matsunaga et al. ..... 439/352
7,252,530 B2 * 8/2007 Shamoto ..... 439/352
2002/0111060 A1 * 8/2002 Challis et al. ..... 439/352
2003/0157825 A1 * 8/2003 Kane ..... 439/352

FOREIGN PATENT DOCUMENTS

DE 9311457 10/1993

* cited by examiner

*Primary Examiner*—Neil Abrams
*Assistant Examiner*—Harshad C Patel
(74) *Attorney, Agent, or Firm*—Darby & Darby

(57) ABSTRACT

An electrical plug connector coupling with first and second plug housings. Each plug housing has a contact and a pair of narrow faces disposed in parallel. At least one of the first and second plug housing includes an insulation material. The electrical plug connector coupling also has a connection device disposed on at least one of the first and at least one of the second narrow faces and operable to connect the first plug housing with the second plug housing in a connected position such that the contacts are connected. A releasing element is disposed on one of the narrow faces. The releasing element has a release position so as to release the first and second plug housings from the connected position when it is moved into the release position. The releasing element is fixable in the release position when the first and second plug housings are in the connected position.

20 Claims, 3 Drawing Sheets

ELECTRICAL PLUG CONNECTOR COUPLING

CROSS REFERENCE TO RELATED APPLICATIONS

German patent application DE 10 2006 054 647.4, filed Nov. 17, 2006, is hereby incorporated by reference herein.

FIELD

The invention concerns an electrical plug connector coupling with a housing of an insulation material, comprising a first plug housing and a second plug housing.

BACKGROUND

Electrical plug connector couplings serve in general to provide the reliable connection of electrical conductors and are designed to transfer electrical energy reliably from a first electrical conductor to a second electrical conductor. Electrical plug connector couplings are used in particular in building services engineering, equipment engineering, as well as in automotive and industrial plants. In industrial plants they are often used in switching and control cabinets with robust metal housings.

High requirements are placed on the plug connector coupling with regard to the reliable connection of its two plug housings, in order to prevent the release of a plug housing allowing the operator direct access to the current carrying conductors, or the formation of a short-circuit.

On the other hand it is also important, however, that the connection of the plug housings can be quickly and simply released to allow defective electrical components on the conductor input side to the plug connector coupling, or on the conductor output side of the plug connector coupling, to be replaced systematically and rapidly in a servicing situation.

In DE 93 11 457 U1, for example, an electrical plug connector coupling of the type cited in the introduction is described. The plug connector coupling consists of two plug housings of an insulation material that can be brought together. Within the two plug housings contact means are arranged with connections for electrical conductors. On two parallel narrow faces of the two plug housings, a latching device is provided for their mechanical connection together and for ensuring the electrical connection between the contact means of the two plug housings.

The latching device comprises two first latching elements. These are supported in an articulated manner on two narrow faces of the first plug housing arranged in parallel with one another. On their ends the two first latching elements have in each case a first engaging part configured as a latching nose.

Furthermore, the latching device possesses two counter-latching elements. These are provided on two narrow faces of the second plug housing arranged in parallel. They comprise, in each case, a second engaging part. When the two plug housings are being brought together the first engaging parts latch together with the second engaging parts when a connection position is achieved, in which the contact means of the two plug housings make contact with each other.

The two first latching elements are configured as latching arms. These are in each case attached via an axis of rotation to the parallel outer faces of the first plug housing. The latching arm can be swivelled around the axis of rotation in a resiliently elastic manner. When the two plug housings are being brought together, the latching arms swivel around their axis of rotation, away from the plug housing in the outward direction, until the connection position is achieved, and the latching arms are moved back into their initial position by a spring force and the first two engaging parts engage into the second two engaging parts.

To release the two plug housings from their connection position, two releasing elements are provided, embodied as actuating elements. With these, the two latching arms are able to swivel in the outward direction and release the connection between the engaging parts.

The actuating elements are arranged in each case as an extension of a latching arm and with reference to its axis of rotation are arranged on the side opposite to the first engaging part. Thus the releasing elements embodied as actuating elements are an integral part of the latching arms, and are embodied in the form of a rocker.

In order to satisfy the wiring task that is becoming ever more complex recently, plug connector couplings with plug housings are being used that consist of a large number of individual modules that together form a row in the width direction. Accordingly the width of the plug connector couplings is becoming ever larger.

SUMMARY

An aspect of the invention is to provide an electrical plug connector coupling in which the plug housings can be released from their connection position in a simple manner.

In an embodiment, the invention provides an electrical plug connector coupling with first and second plug housings. Each plug housing has a contact and a pair of narrow faces disposed in parallel. At least one of the first and second plug housing includes an insulation material. The electrical plug connector coupling also has a connection device disposed on at least one of the first narrow faces and at least one of the second narrow faces and operable to connect the first plug housing with the second plug housing in a connected position such that the contacts are connected. A releasing element is disposed on one of the narrow faces. The releasing element is disposable in a release position so as to release the first and second plug housings from the connected position when it is moved into the release position. The releasing element is fixable in the release position when the first and second plug housings are in the connected position.

BRIEF DESCRIPTION OF THE DRAWINGS

The present invention is described in further detail in the following with respect to exemplary embodiments and the drawings, in which.

DETAILED DESCRIPTION

Figure 1:
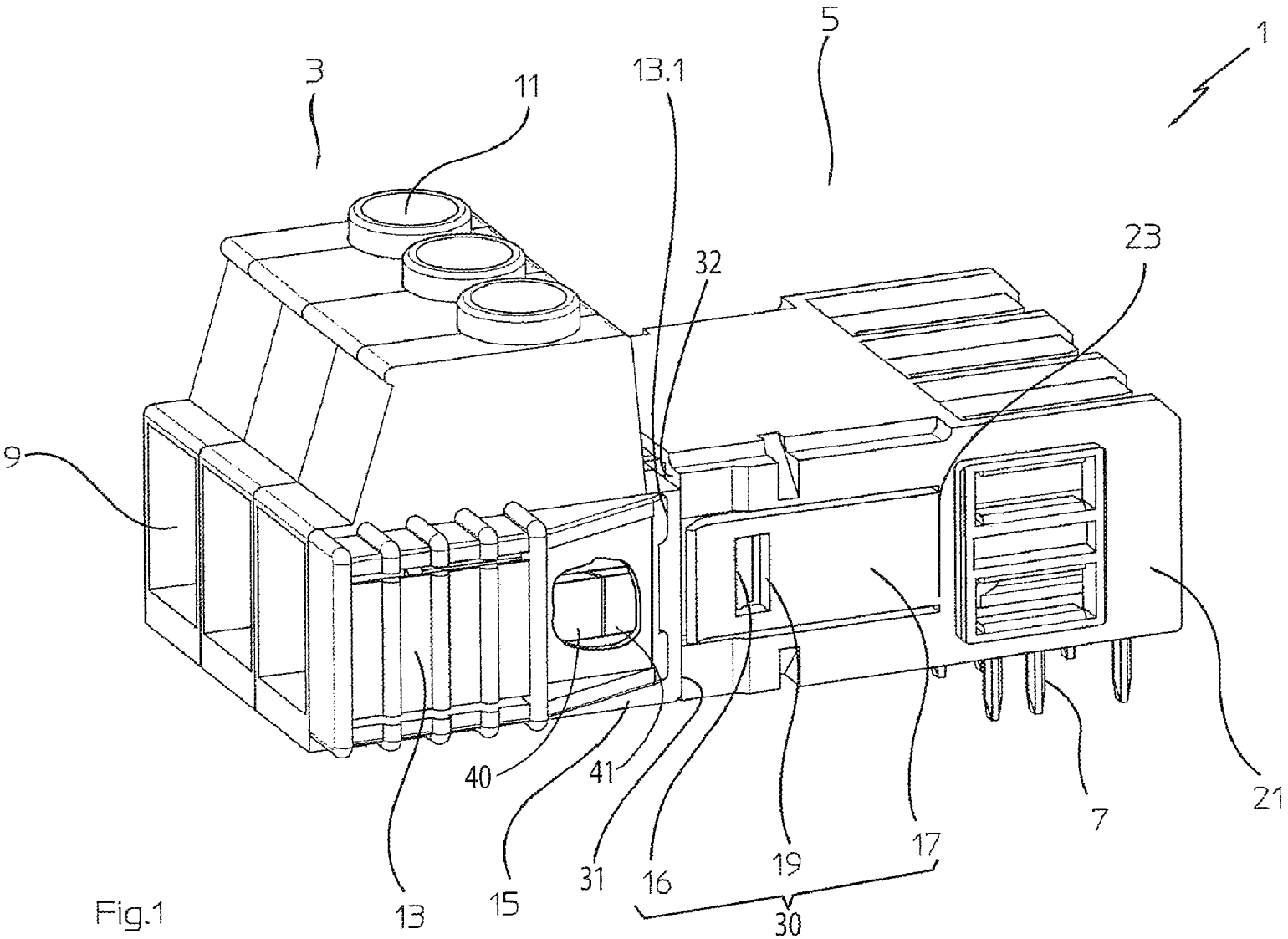
FIG. 1 shows a perspective view of an electrical plug connector coupling with two plug housings in a connection position having a cut-away showing first and second contacts making contact, wherein the two plug housings are connected together by a latching element provided on their narrow faces.

In an embodiment, the present invention provides an electrical plug connector coupling with a housing of an insulation material comprising a first plug housing with a first contact means and two narrow faces of the first housing arranged in parallel, and a second plug housing, in particular a base plate with solder pins for a printed circuit board, with a second contact means and two narrow faces of the second housing arranged in parallel, wherein the two plug housings can be brought together manually and via a connecting means arranged on each of the housing narrow faces can be connected together, wherein in this connection position the contact means make contact with one another, and wherein the two plug housings can be released from their connection position via releasing elements arranged on the narrow faces of the first housing or on the narrow faces of the second housing and brought into a release position, in that at least one releasing element can be fixed in the release position with plug housings that are in the brought together state.

In an embodiment of the invention, the separation of the plug housings can take place in two steps that can be carried out one after another. In the first step the releasing element can be fixed in the release position and in the subsequent second step the plug housings can be pulled apart. This division of the method steps significantly simplifies manipulation and handling when separating the plug housing. This is in particular the case if the plug connector coupling is so wide that the user can hardly grasp it, or cannot grasp it at all with one hand and thus the two releasing elements arranged on the parallel housing narrow faces cannot be simultaneously operated with one hand.

In one embodiment of the invention the releasing element is supported in an articulated manner as a separate part that is detached from the connecting means.

In an embodiment, the releasing element is a separate part that is detached from the connection device, which is supported in an articulated manner, the releasing element can be inserted as a narrow external tool, for example in the form of a screwdriver tip, in order to release the connection device. Since the connection device does not comprise the releasing element, the latter can also be embodied as a very flat structure. Moreover the functional and spatial detachment of the releasing element from the connection device offers the advantage that both the releasing element and the connection device can each be optimised on their own with regard to their size.

In one embodiment of the invention the releasing element can be displaced under guidance from an initial position into the release position to release the plug connector from its connection position. By this means, the width of the plug connector coupling can be further constrained, because the space for movement of the releasing element extends along the plug housing, so that no space for movement, or operating, i.e. manipulation, space, is required in the width direction of the plug connector coupling housing.

In one embodiment of the invention connection device comprises a latching element, which is supported such that it can swivel or rotate, wherein the releasing element can be displaced. By the use of a latching element as well as the division and assignment of the types of movement, a very reliable and robust connection (a latching connection) is on the one hand created between the plug housings. On the other hand this connection is very simple to release, even if the width of the plug connector coupling is small.

The build space can be further reduced if the latching element is an integral part of a housing narrow face. Accordingly, the thickness of the latching element, as considered in the width direction of the plug connector coupling, can be reduced at least by the thickness of the housing narrow face.

FIG. 1 shows an electrical plug connector coupling 1 with a housing of insulation material, preferably of plastic.

The plug connector coupling 1 is formed from a first plug housing 3 and a second plug housing 5.

Figure 2:
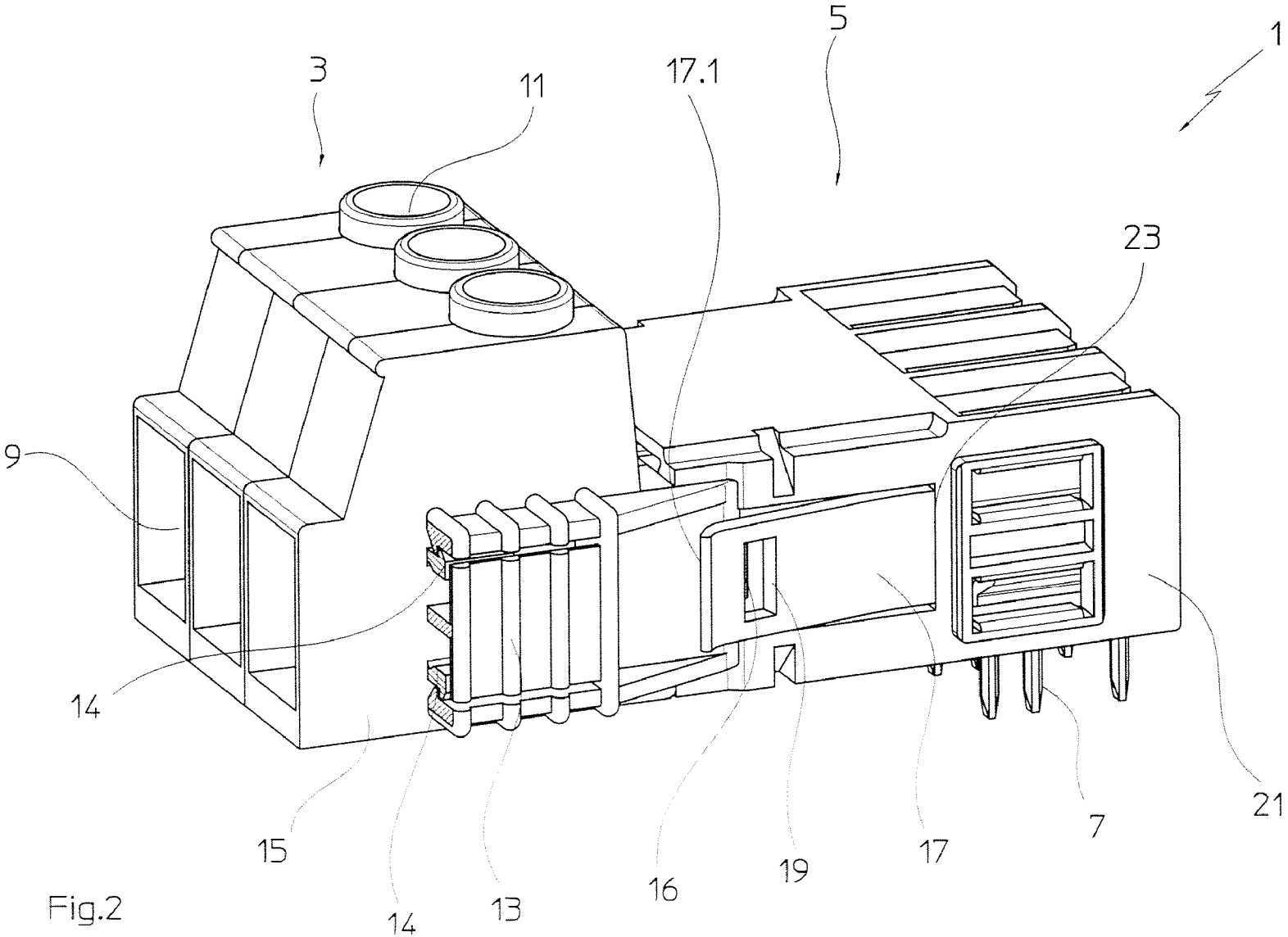
FIG. 2 shows a perspective view of the plug connector coupling according to FIG. 1 with a releasing element attached to a housing narrow face, by means of which the connection position of the plug housings is released.

The first plug housing 3 is configured for the connection of electrical conductors. It has feed shafts 9 configured in the shape of funnels for the introduction of electrical conductors, which shafts lead to a first contact 40, for example a pin or a socket within the first plug housing 3. To clamp and connect conductors that have been introduced into the plug housing 3 with the first contact 40, a screwed connection is provided in the present embodiment, which is accessible with a tool from the upper face of the first plug housing 3 via a hole 11 in the housing. The first plug housing 3 also includes a releasing element 13 mounted on its first narrow face 15, As can be seen in FIGS. 1 and 2 together, the releasing element 13 can be displaced manually from an initial position shown in FIG. 1 along its housing narrow face 15 to the mating face 31 of the first plug housing 3 into a release position and brought back again. In order to enable this displacement the releasing element is guided on bars 14. Alternatively it is also conceivable that the releasing element 13 has an engaging part, which engages in one or a plurality of grooves configured on the narrow face 15 of the first housing.

Near the mating face 31 of the first plug housing 3, an immovable latching nose 16 is formed on the narrow face 15 of the first housing as a first integral part of a connecting device 30 of the two plug housings 3, 5.

The second plug housing 5 may be configured as a base plate with solder pins 7 for the connection of a printed circuit board. Second plug housing includes second contact 41. It has a latching tongue 17 with a cut-out 19, which is a second integral part of the connecting device. The latching tongue 17 is configured in a manner corresponding to the latching nose 16.

On a narrow face 21 of the second housing the latching tongue 17 can be swivelled about a swivel axis 23, for example, as an integral part of the narrow face 21 of the second housing. The swivel axis 23 is aligned parallel with the mating face 32 of the second plug housing 5, so that the latching tongue 17, as shown in FIG. 2 and FIG. 3, can swivel outwards away from the narrow face 21 of the second housing.

Figure 3:
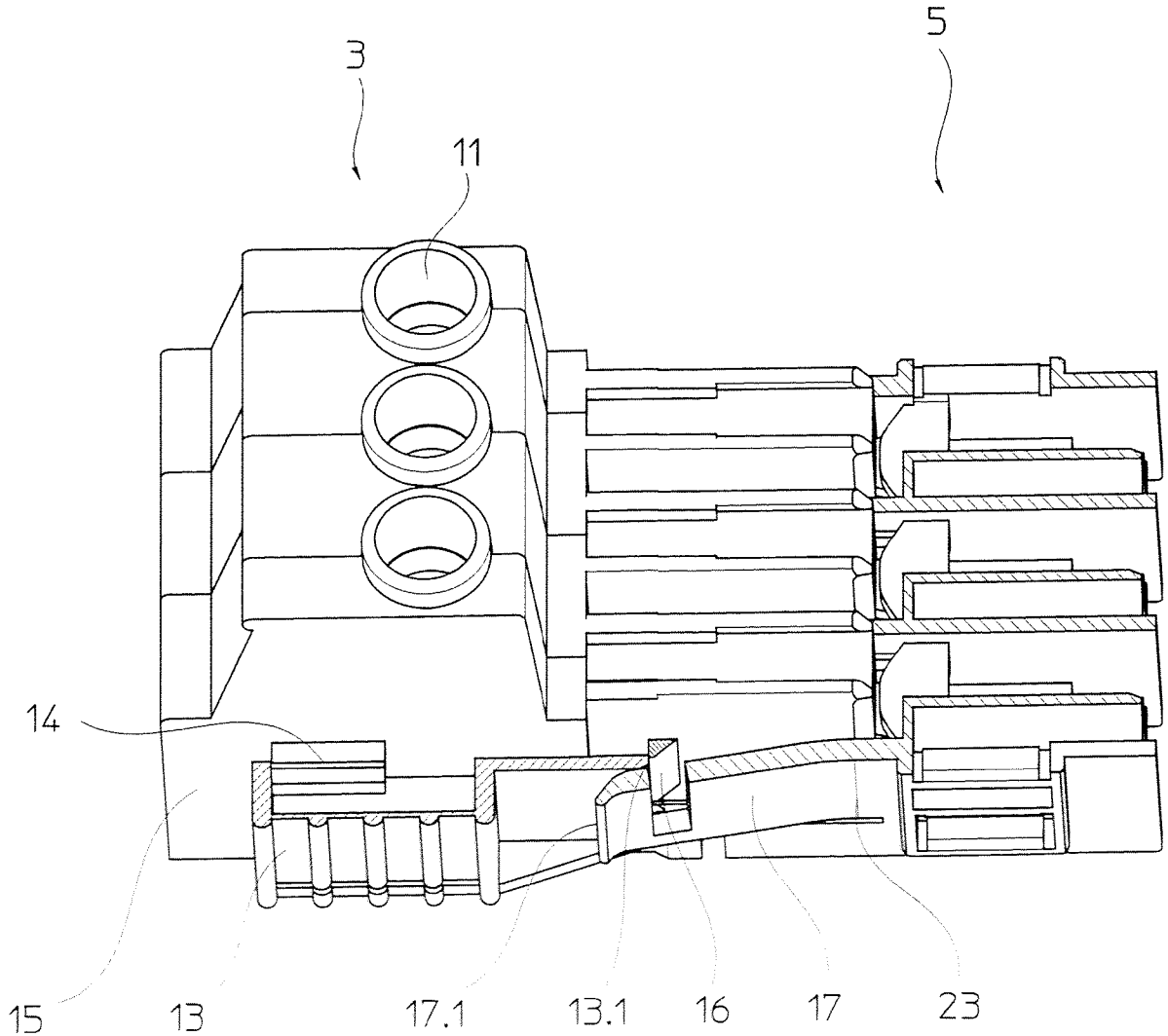
FIG. 3 shows the plug connector coupling in the connection position of FIG. 2 in perspective, with a connecting means and a releasing element represented in section in the longitudinal direction.

The plug housings 3, 5 in a brought together state are represented in FIGS. 1 to 3, wherein the plug housings 3, 5 shown in FIG. 1 are mechanically connected together and are thus located in their connection position. This connection position is distinguished by the fact that the latching nose 16 engages into the cut-out 19 of the latching tongue 17. By means of this form fit connection, the two plug housings 3, 5 are in particular secured against any pull in the longitudinal direction of the plug connector coupling 1.

When the two plug housings 3, 5 are being brought together the connection position is achieved in that the latching tongue is swivelled outward by the latching nose 16, wherein when the connection position is reached the latching tongue 17 swivels back as a result of its restoring force into its initial position and the latching nose 16 engages into the cut-out 19.

In order to be able to release the two plug housings 3, 5 from their connection position and to be able to separate them, the releasing element 13 is displaced from its initial position in the direction of the second plug housing until the release position shown in FIGS. 2 and 3 is achieved. In this release position the latching tongue 17 is swivelled outward to the extent that the latching nose 16 and the cut-out 19 of the latching tongue 17 are no longer in engagement.

This swivelling movement of the latching tongue 17 is achieved by displacement of the releasing element 13 such that in this displacement process the releasing element 13 engages between the latching tongue 17 and the corresponding region of the narrow face 21 of the second housing, wherein the swivel angle of the latching tongue 17 to the housing narrow face 21 becomes larger with reducing distance between the releasing element 13 and the swivel axis 23. To feed the releasing element in between the latching tongue 17 and the housing narrow face 21 the latching tongue 17 at its free end 17.1 has a curvature configured in the form of a ski tip, which points outward away from the narrow face 21 of the second housing.

The releasing element 13 is fixed against any self-activated displacement out of the release position in the direction of its initial position. For this purpose there are numerous options.

For example, this fixing can be implemented by small latching elements that can be overridden in the displacement path of the releasing element 13. According to the present embodiment provision is made for the fixing in that the latching tongue 17 and the releasing element 13 are configured such that when the plug housings 3, 5 are in the brought together state the latching tongue 17 presses onto the releasing element 13, and via this contact pressure fixes the releasing element 13 in its release position against any axial displacement. This can come about in particular by matching the curvature of the two surfaces of the latching tongue 17 and the releasing element 13 that lie against each other.

Furthermore, the free end 17.1 of the latching tongue 17 pointing towards the mating face of the second plug housing 5 and also the free end 13.1 of the releasing element 13 pointing towards the mating face of the first plug housing 3 are matched to each other in their geometry such that when the two plug housings 3, 5 are in the brought together state, the two free ends 13.1, 17.1 impinge together and the latching tongue 17 displaces the releasing element 13 out of the release position in the direction of its initial position.

This ensures that when the two plug housings 3, 5 are in the brought together state and when the connection position is achieved, the two plug housings 3, 5 are immediately and automatically connected on each occasion. In the present embodiment, represented in the figures, the displacement of the releasing element 13 by the latching tongue 17 positively prevents the releasing element 13 from remaining in its release position when the plug housings 3, 5 are plugged together, and prevents the latching tongue 17 and the latching nose 16 from being latched together.

A second embodiment of the plug connector coupling may comprise two plug housings of insulation material that can be brought together manually. Within the two plug housings, contacts are arranged with connections for electrical conductors. On two parallel narrow faces of the two plug housings a latching device is provided for their mechanical connection together.

The latching device comprises two first latching elements. These are supported in an articulated manner on two narrow faces of the first plug housing arranged in parallel with one another. On their ends, the two first latching elements in each case have a first engaging part configured as a latching nose.

Furthermore the latching device possesses two counter-latching elements. These are fixed on two narrow faces of the second plug housing arranged in parallel. They comprise, in each case, a second engaging part. When the two plug housings are brought together, the first engaging parts latch together with the second engaging parts to achieve a connection location in which the contact means of the two plug housings make contact with each other.

The two first latching elements are configured as latching arms. These are, in each case, attached via an axis of rotation to the parallel outer faces of the first plug housing. The latching arm can be swivelled around the axis of rotation in a resiliently elastic manner. When the two plug housings are brought together, the latching arms swivel around their axis of rotation, away from the plug housing in the outward direction, until the connection position is achieved and the latching arms are moved back into their initial position by a spring force, and the first two engaging parts engage with the second two engaging parts.

To release the two plug housings from their connection position, two releasing elements are provided, embodied as actuating elements. With these, the two latching arms can swivel in the outward direction into a release position in which the connection between the engagement parts is released.

The actuating elements are arranged, in each case, in an extension of a latching arm and with reference to its axis of rotation are arranged on the side opposite to the first engaging part.

In order to be able to maintain and fix the release position, a cut-out is provided on the narrow housing faces underneath the actuating elements. The dimensions of the cut-out in question are selected such that with the application of force, the actuating element arranged above it can be pushed into the cut-out and can be held in it via an appropriate force fit. In this position of the actuating element, the latching arm attached to the actuating element is located in the release position.

While the invention has been described in connection with certain embodiments thereof, the invention is capable of being practiced in other forms and using other materials and structures. Accordingly, the invention is defined without limitation by the recitations in the claims appended hereto and equivalents thereof.

I claim:

1. An electrical plug connector coupling comprising:

a first plug housing including a first contact and a pair of first narrow faces arranged in parallel;

a second plug housing including a second contact and a pair of second narrow faces arranged in parallel, at least one of the first and second plug housings including an insulation material;

a connection device disposed on at least one of the first narrow faces and at least one of the second narrow faces and operable to connect the first plug housing with the second plug housing in a connected position, the first and second contacts being in contact in the connected position; and at least one slideable releasing element disposed on one of the first narrow faces or the second narrow faces, the releasing element being slideable into a release position so as to release the first and second plug housings from the connected position, the releasing element being fixable in the release position when the first and second plug housings are in the connected position.

2. The electrical plug connector coupling as recited in claim 1 wherein the second plug housing comprises solder pins for a printed circuit board.

3. The electrical plug connector coupling as recited in claim 1 wherein the releasing element is fixable in the release position by a retention device.

4. The electrical plug connector coupling as recited in claim 3 wherein the retention device includes a latching device.

5. The electrical plug connector coupling as recited in claim 1 wherein the releasing element is supported on the one of the first narrow faces or the second narrow faces in an articulated manner and is detached from the connection device.

6. The electrical plug connector coupling as recited in claim 1 wherein the releasing element is fixable in the release position by the connection device.

7. The electrical plug connector coupling as recited in claim 1 wherein the releasing element is operable to release the plug housings from the connected position when the releasing element is moved from an initial position to the release position.

8. The electrical plug connector coupling as recited in claim 7 wherein the releasing element is fixable in the release position against displacement from the release position in a direction of the initial position.

9. The electrical plug connector coupling as recited in claim 1 wherein the connection device comprises a latching element, and wherein the releasing element is displaceable and the latching element is swivelable.

10. The electrical plug connector coupling as recited in claim 1 wherein the connection device comprises a latching element, and wherein the releasing element is swivelable and the latching element is displaceable.

11. The electrical plug connector coupling as recited in claim 1, wherein the connection device comprises a latching element as an integral part of the one of the first narrow faces or the second narrow faces.

12. The electrical plug connector coupling as recited in claim 1, wherein the releasing element is disposed on the first plug housing and is movable thereon, and wherein the connection device comprises a latching element supported on the second plug housing in an articulated manner.

13. The electrical plug connector coupling as recited in claim 1, wherein the connection device comprises at least one latching nose disposed on one of the first narrow faces and at least one latching tongue disposed on one of the second narrow faces, the latching tongue including a cut-out configured to correspond to the latching nose.

14. The electrical plug connector coupling as recited in claim 13, wherein the latching tongue is swivelable away from the one second narrow face against an elastic restoring force, the latching tongue and the latching nose being configured to act together such that the latching tongue is swiveled away from the one second narrow face when the first and second plug housings are brought together and the latching tongue is swiveled into an initial position by the restoring force when the plug housings are in the connected position such that the latching nose engages into the cut-out of the latching tongue.

15. The electrical plug connector coupling as recited in claim 14, wherein a free end of the latching tongue has a curvature in the form of a ski tip pointing away from the one second narrow face.

16. The electrical plug connector coupling as recited in claim 15, wherein a free end of the releasing element is configured such that when the first and second plug housings are in the connected position the free end is displaceable between the latching tongue and the one second narrow face as the releasing element is moved into the release position such that the latching tongue is swiveled away from the one second narrow face and the first and second plug housings are released from the connection position.

17. The electrical plug connector coupling as recited in claim 15, wherein when the releasing element is in the release position and the first and second plug housings are in the connection position, the latching element fixes against displacement the releasing element in the release position by contact pressure.

18. The electrical plug connector coupling as recited in claim 14 wherein a first mating face on a free end of the releasing element and a second mating face on a free end of the latching tongue are matched so that the free ends impinge together and the free end of the latching tongue displaces the releasing element out of the release position when the first and second plug housings are brought into the connected position.

19. The electrical plug connector coupling as recited in claim 1 wherein the connection device is configured such that the first and second plug housings are automatically connected when the first and second plug housings are in the connection position.

20. An electrical plug connector coupling comprising:

a first plug housing having a first connector therein and parallel first narrow faces;

a second plug housing having a second connector therein and parallel second narrow faces, the second plug housing being configured to connect with the first plug housing in a connected position wherein the first and second connectors are in contact;

a latching nose disposed on one of the first narrow faces of the first plug housing;

a latching element disposed on a respective second narrow face of the second plug housing, the latching element being swivelable away from the narrow faces of the first and second plug housings and including a cut-out configured to engage the latching nose, such that the latching element is swiveled away from as the first and second plug housings are brought together until the first and second plug housings are in the connected position and the cut-out engages the latching nose; and a slideable releasing element disposed on the first narrow face with the latching nose and configured to slide from an initial position to a release position between the respective narrow faces and a latching tongue such that the cut-out and the latching nose are disengaged, wherein the releasing element is held in the release position by the latching tongue when the first and second plug housings are in the connected position.

* * * * *